US011071430B2

(12) United States Patent
Zhang

(10) Patent No.: US 11,071,430 B2
(45) Date of Patent: Jul. 27, 2021

(54) SEAL ASSEMBLY FOR WASTE WATER TANK

(71) Applicant: SHENZHEN ZHIYI TECHNOLOGY CO., LTD., Guangdong (CN)

(72) Inventor: Xuedong Zhang, Guangdong (CN)

(73) Assignee: SHENZHEN ZHIYI TECHNOLOGY CO., LTD., Shenzhen (CN)

( * ) Notice: Subject to any disclaimer, the term of this patent is extended or adjusted under 35 U.S.C. 154(b) by 394 days.

(21) Appl. No.: 16/099,185

(22) PCT Filed: Aug. 30, 2016

(86) PCT No.: PCT/CN2016/097250
§ 371 (c)(1),
(2) Date: Nov. 5, 2018

(87) PCT Pub. No.: WO2018/039890
PCT Pub. Date: Mar. 8, 2018

(65) Prior Publication Data
US 2019/0208976 A1 Jul. 11, 2019

(51) Int. Cl.
*A47L 11/30* (2006.01)
*A47L 11/40* (2006.01)
*A47L 11/29* (2006.01)

(52) U.S. Cl.
CPC ..... *A47L 11/30* (2013.01); *A47L 11/29* (2013.01); *A47L 11/40* (2013.01)

(58) Field of Classification Search
CPC ..... A47L 11/40; A47L 11/12; A47L 11/29; A47L 11/162
See application file for complete search history.

(56) References Cited

U.S. PATENT DOCUMENTS 6,425,958 B1 * 7/2002 Giddings ..... A47L 11/03 134/21
2003/0019069 A1 * 1/2003 Field ..... A47L 11/03 15/320

FOREIGN PATENT DOCUMENTS

| | | | |
|---|---|---|---|
| CN | 201060415 | Y | 5/2008 |
| CN | 201414755 | Y | 3/2010 |
| CN | 204105901 | U | 1/2015 |
| CN | 204169788 | U | 2/2015 |
| JP | 09206262 | A | 8/1997 |
| JP | 2014131753 | A | 7/2014 |
| JP | 2015516281 | A | 6/2015 |

OTHER PUBLICATIONS

International Search Report of PCT Patent Application No. PCT/CN2016/097250 dated Jun. 2, 2017.

* cited by examiner

*Primary Examiner* — Michael D Jennings

(57) ABSTRACT

A seal assembly for a waste water tank. The seal assembly comprises: a base (2) disposed at a waste water tank (1); a linkage (3) movably disposed at the base (2); a sealing cover (4) connected to the linkage (3) and disposed at a waste water inlet (101) and on a suction opening (102); and a push rod (5) connected to the linkage (3) and used for pushing the linkage (3) to press the sealing cover (4) so as to seal the waste water inlet (101) and the suction opening (102). A bottom end of the push rod (5) is connected to a side wheel component (6) of a floor cleaning machine and the push rod (5) can move up and down along the side wheel component (6).

8 Claims, 5 Drawing Sheets

SEAL ASSEMBLY FOR WASTE WATER TANK

TECHNICAL FIELD

The present application relates to technical field of floor cleaning machine, and more particularly to a seal assembly for waste water tank.

BACKGROUND

Environmental sanitation is an important factor affecting the quality of life, therefore, with the continuous improvement of people's quality of life requirements, the corresponding requirements for environmental sanitation are getting higher and higher. However, the work pressure of modern people are daily increase, which are urgently needed to liberate from the cleaning works, so there were many devices for cleaning floor are appeared to improve the environmental sanitation. Commonly used are vacuum cleaners, automatic mopping machines, floor sweeping machines and floor cleaning machines.

The existing waste water tank of the floor cleaning machine adopts the floating block sealing technology, the principle thereof is to use the floating block with lower density than water to float the floating block on the surface of the waste water. When the waste water rises to a certain height, the floating block is rose to block the waste water suction opening forming a sealed under the action of buoyancy. However, when the waste water does not reach the sealing height, the floating block cannot seal the waste water suction opening, so if the whole machine or the water tank is picked up, the water leakage may occur, which may cause the water flow into the fan of the floor cleaning machine, and cause the fan motor to burn out, or the waste water will flow out, resulting in a bad user experience.

SUMMARY

An objective of the present application is to provide a seal assembly for waste water tank, in order to solve the problem that in the prior art, the existing waste water tank of the floor cleaning machine adopts floating block sealing technology and is easy to occur leakage phenomenal.

The embodiment of the present application provides a seal assembly for waste water tank, which is installed to a waste water tank of a floor cleaning machine and configured for sealing a waste water inlet and a suction opening, the seal assembly for waste water tank comprises: a base disposed at the waste water tank, a linkage movably disposed at the base, a sealing cover connected to the linkage and disposed at the waste water inlet and on the suction opening, and a push rod connected to the linkage and configured for pushing the linkage to press the sealing cover so as to seal the waste water inlet and the suction opening; a bottom end of the push rod is connected to a side wheel component of a floor cleaning machine, and the push rod is movable up and down synchronously with the side wheel component.

Further, the linkage includes: a link assembly movably disposed at the base, and a torsion spring for restoring the link assembly; the sealing cover being connected to one side of the link assembly, a top end of the push rod is connected at the other side of the link assembly.

Further, the link assembly includes: a rotational shaft rotatably disposed at the base, a pair of cantilevers connected to opposite ends of a same side of the rotational shaft, and a first link connected to the rotational shaft and located on an opposite side of the cantilever, and a second link rotatably disposed at the base and located beside the first link; one end of the second link abuts against a top side of the first link, and the other end of the second link connects a top end of the push rod; the torsion spring is disposed through on the rotational shaft, and two ends of the torsion spring respectively abut against the base and a bottom side of the first link; the sealing cover is connected to an outer end of the cantilever.

Further, the base includes: a first support base and a second support base; the second support base is perpendicular to the first support base; the rotational shaft is rotatably disposed at the first support base, and the second link is rotatably disposed at the second support base.

Further, the base further includes: a guide plate having a guide hole, the guide plate is disposed in parallel to a side of the second support base, and the push rod is movably disposed through in the guide hole.

Further, opposite sides of the second link has a protruding rotating arm, and the second support base is provided with a notch adapted to the rotating arm, and the rotating arm is rotatably accommodated inside the notch.

Further, a limiting groove is disposed at a bottom side of the first link, and one end of the torsion spring abuts within the limiting groove.

Further, the side wheel component includes: a transmission box, a side wheel and a tension spring, and opposite ends of the transmission box respectively being a transmission end and a connection end, the lower side of the connection end is rotatably connected with main body of the floor cleaning machine, and two ends of the tension spring are respectively connected to an upper side of the connecting end and the main body, the side wheel is disposed at the transmission end, and a bottom end of the push rod is connected with the transmission end.

Based on the above technical solution, compared with the prior art, the seal assembly for waste water tank provided by the embodiment of the present application, the linkage respectively connect to the sealing cover movably covered at the waste water inlet and at the suction opening, and to the push rod of the side wheel component, using the side wheel component that can move up and down to drive the push rod to move up/down, thereby driving the linkage to simultaneously press down or lift up the sealing cover, thereby implementing sealing of the sealing cover or opening the waste water inlet and the suction opening, thus avoiding the problem of water leakage caused by the failure of the waste water inlet and the suction opening when the whole washing machine or the waste water tank is picked up, thereby preventing the waste water from flowing out of the waste water tank and soiling the floor or other objects, thereby improving the user experience; in addition, the effective sealing of the waste water inlet and the suction opening of the waste water tank avoids the problem that the waste water flow into the interior of the floor cleaning machine and causes short circuit, thereby prolonging the service life of the floor cleaning machine.

DETAILED DESCRIPTION OF THE EMBODIMENTS

Figure 1:
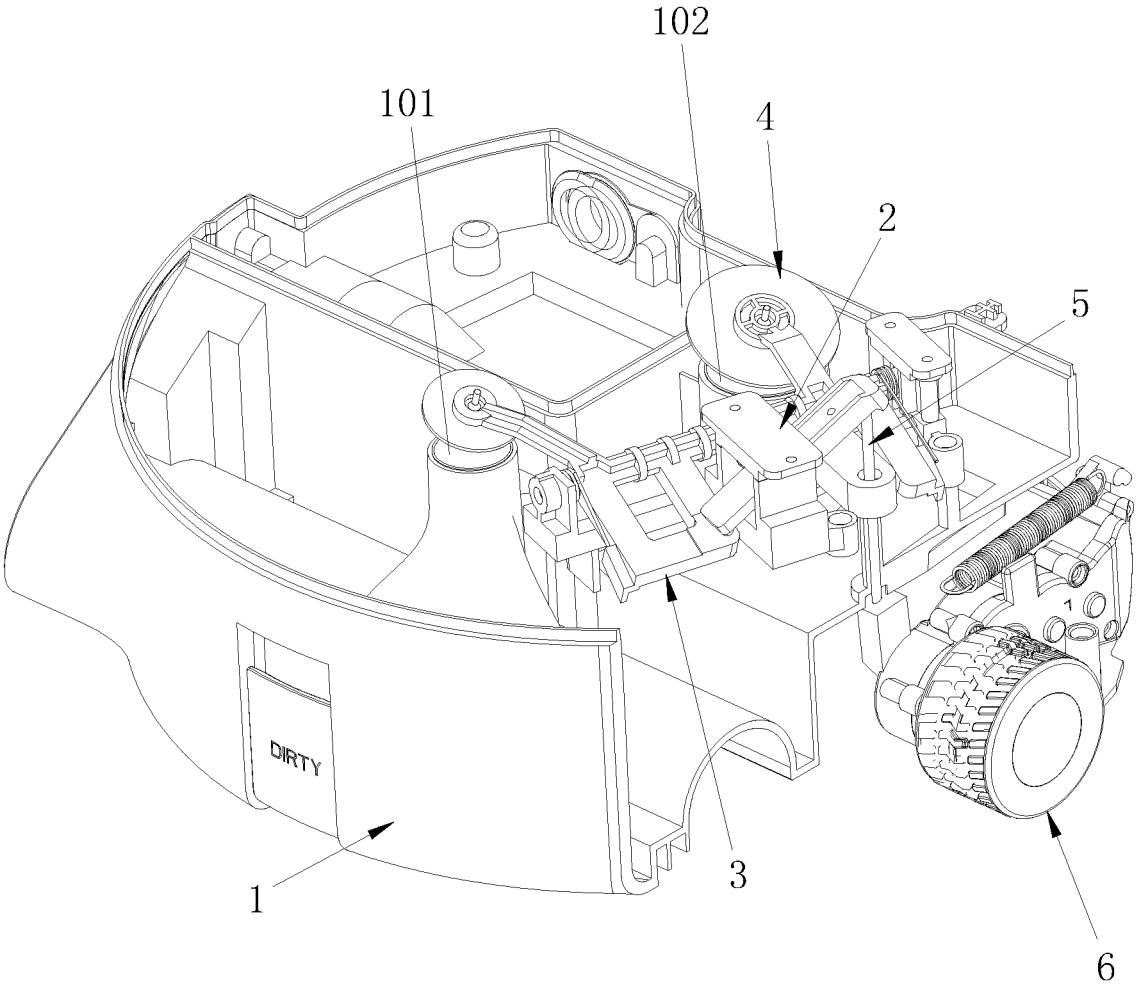
FIG. 1 is a schematic structural view of a seal assembly for waste water tank installed in a waste water tank according to an embodiment of the present application.

In order to make the purpose, the technical solution and the advantages of the present application be clearer and more understandable, the present application will be further described in detail below with reference to accompanying figures and embodiments. It should be understood that the specific embodiments described herein are merely intended to illustrate but not to limit the present application.

It is noted that when a component is referred to as being "fixed to" or "disposed at" another component, it can be directly or indirectly on another component. When a component is referred to as being "connected to" another component, it can be directly or indirectly connected to another component.

In addition, it should be noted that the terms of the left, right, upper, and lower orientations in the embodiments of the present invention are only relative concepts or reference to the normal use state of the product, and should not be considered as having limitations. The implementation of the present application will be described in detail below with reference to specific embodiments.

As shown in FIG. 1 to FIG. 5, the embodiment of the present application provides a seal assembly for waste water tank, which is installed on the waste water tank 1 of the floor cleaning machine, and is used for sealing the waste water inlet 101 and the suction opening 102 of the waste water tank 1, the waste water inlet 101 is disposed at the top of the waste water flow path of the waste water tank 1 herein. Specifically, the seal assembly for waste water tank may include a base 2, a linkage 3, a sealing cover 4 and a push rod 5, wherein the base 2 is disposed at the waste water tank 1, and the linkage 3 is movably disposed at the base 2, the sealing cover 4 includes a first sealing cover 41 and a second sealing cover 42 respectively adapted to the waste water inlet 101 and the suction opening 102, where the first sealing cover 41 and the second sealing cover 42 are respectively movable and sealed at the waste water inlet 101 and the suction opening 102, and the first sealing cover 41 and the second sealing cover 42 are respectively connected to the linkage 3. In addition, the push rod 5 is used to push the linkage 3 while pressing the first sealing cover 41 and the second sealing cover 42 for sealing the waste water inlet 101 and the suction opening 102 respectively, wherein the top end of the push rod 5 is connected to the linkage 3, and the bottom end of the push rod 5 is connected to the side wheel component 6 of the floor cleaning machine, the side wheel component 6 is movably connected to the main body of the floor cleaning machine herein. When the waste water tank 1 or the floor cleaning machine is lifted and suspended from the floor, one end of the side wheel component 6 is moved downward, and the push rod 5 is vertically moved downward, at the same time, the linkage 3 is pressed the first sealing cover 41 and the second sealing cover 42 to seal the waste water inlet 101 and suction opening 102; otherwise, when the floor cleaning machine is placed on the floor, the side wheel component 6 contacts the bottom surface and moves up relatively, and the side wheel component 6 pushes the push rod 5 moving up vertically, the top end of the push rod 5 is lifted one side of the linkage 3 up, and at the same time, the first sealing cover 41 and the second sealing cover 42 of the linkage 3 are pulled to open the waste water inlet 101 and the suction opening 102, in this way, the waste water can smoothly enter the inner chamber of the waste water tank 1 from the waste water flow path through the waste water inlet 101.

As described above, the seal assembly for waste water tank provided by the embodiment of the present application, the linkage 3 respectively connect to the sealing cover 4 movably covered at the waste water inlet 101 and at the suction opening 102, and to the push rod 5 of the side wheel component 6, using the side wheel component 6 that can move up and down to drive the push rod 5 to move up/down, thereby driving the linkage 3 to simultaneously press down or lift up the sealing cover 4, thereby implementing sealing of the sealing cover 4 or opening the waste water inlet 101 and the suction opening 102, thus avoiding the problem of water leakage caused by the failure of the waste water inlet 101 and the suction opening 102 when the whole washing machine or the waste water tank is picked up, thereby preventing the waste water from flowing out of the waste water tank and soiling the floor or other objects, thereby improving the user experience; in addition, the effective sealing of the waste water inlet 101 and the suction opening 102 of the waste water tank avoids the problem that the waste water flow into the interior of the floor cleaning machine and causes short circuit, thereby prolonging the service life of the floor cleaning machine.

Further, in the embodiment of the present application, the linkage 3 may include a link assembly 31 and a torsion spring 32, wherein the linkage 3 is movably disposed at the base 2, and the sealing cover 4 is connected to one side of the link assembly 31, specifically, the first sealing cover 41 and the second sealing cover 42 are respectively connected to the same side of the link assembly 31, and the top end of the push rod 5 is connected to the other side of the link assembly 31, the torsion spring 32 is disposed at the linkage 3 herein for restoring the link assembly 31. Of course, the above-mentioned linkage 3 can also be in other forms, which is not limited herein.

Further, in the embodiment of the present application, the link assembly 31 includes a rotational shaft 311, a cantilever 312, a first link 313, and a second link 314, wherein the rotational shaft 311 is erected on the base 2 and rotatably connected to the base 2, that is, the rotational shaft 311 is axially rotatable on the base 2. The cantilever 312 includes a pair of cantilevers connected to both ends of the same side of the rotational shaft 311, that is, a first cantilever 3121 and a second cantilever 3122, the first sealing cover 41 and the second sealing cover 42 are respectively connected to outer end of the first cantilever 3121 and outer end of the second cantilever 3122. In this embodiment, the first link 313 is connected to the rotational shaft 311 and is located on the opposite side of the cantilever 312, the first link 313 is preferably plate-shaped herein. Of course, the first link 313 may have other shapes. In addition, the second link 314 is rotatably disposed at the base 2 and located at a side of the first link 313, one end of the second link 314 abuts against the top side of the first link 313 herein, and the other end of the second link 314 is connected with the top end of the push rod 5, wherein the middle portion of the second link 314 is rotatably connected to the base 2, such that the second link 314 is similar to the "teeterboard", which is moved upward at one end, the other end moves down. That is to say, when the push rod 5 is moved up, the top end of the second link 314 is lifted up, the other end of the second link 314 is moved down and the first link 313 is depressed, and the first link 313 drives the rotational shaft 311 rotating clockwise, at the same time, the first cantilever 3121 and the second cantilever 3122 are also rotated clockwise by the rotation shaft 311, so that the first sealing cover 41 and the second sealing cover 42 are lifted up, so that the waste water inlet 101 and the suction opening are opened.

In addition, in the embodiment, two torsion springs 32 are disposed at the rotational shaft 311, and the two torsion springs 32 are respectively located at both ends of the rotational shaft 311. the two end of the torsion springs 32 of the rotational shaft 311 adjacent to the first link 313 are respectively abutted on the bottom sides of the base 2 and the first link 313, and at the same time, the two ends of the torsion spring 32 at the other end of the rotational shaft 311 are abutted against the bottom sides of the base 2 and the baffle 315 respectively, the baffle 315 is integrally connected to the rotational shaft 311. When the push rod 5 is moved down, one end of the second link 314 moves downward with the push rod 5 to form a rotation, and the other end of the second link 314 is lifted up to be separated from the top side of the first link 313, and at the same time, Under the action of the torsion spring 32 restoring force, the first link 313 rotates counterclockwise, the first cantilever 3121 and the second cantilever 3122 rotate counterclockwise synchronously and press down the first sealing cover 41 and the second sealing cover 42 such that the waste water inlet 101 and the suction opening 102 is sealed. As described above, through the transmission cooperation of the rotational shaft 311, the cantilever 312, the first link 313, the second link 314, the torsion spring 32, and the push rod 5, the sealing of the waste water inlet 101 and the air extracting port 102 is firm and reliable, which effectively avoids the problem that failure sealing of the waste water inlet 101 and the suction opening 102 and occurs water leakage when the floor cleaning machine or the waste water tank 1 is picked up. In other embodiments of the present application, the link assembly 31 may also be in other forms, which are not limited herein.

Further, in the embodiment of the present application, the rotational shaft 311, the cantilever 312, and the first link 313 are integrally formed. In this way, the consistency and synchronism of the rotation of the cantilever 312 and the first link 313 are ensured. Of course, in the other embodiments of the present application, the rotational shaft 311, the cantilever 312, and the first link 313 may be fixed-connected split parts, which are not limited herein.

Further, in the embodiment of the present application, the base 2 may include a first support base 21 and a second support base 22, and the second support base 22 is located on the side of the first support base 21 and perpendicular thereto. The rotational shaft 311 is rotatably mounted on the first support base 21, and the second link 314 is rotatably disposed at the second support base 22. Of course, according to the actual situation and the specific requirements, in the other embodiments of the present application, the above-mentioned base 2 may also be in other structural forms, which is not limited herein.

Further, in the embodiment of the present application, the base 2 may further include a guide plate 23 disposed in parallel to the side of the second support base 22 and integrally connected with the first support base 21. The guide plate 23 has a guide hole 230 herein, and the push rod 5 is movably disposed through in the guide hole 230. Thus, by disposing the guide plate 23 having the guide hole 230, the up and down movement of the push rod 5 is imparted, and the reliability of the movement is ensured. Of course, according to the actual situation and the specific requirements, in other embodiments of the present application, the up and down movement of the push rod 5 can be guided by other means, which is not limited herein.

Further, in the embodiment of the present application, the opposite sides of the second link 314 have a protruding rotating arm 3141. Correspondingly, the second support base 22 is provided with a notch 220 for adapting to the rotating arm 3141. The rotating arm 3141 is rotatably accommodated inside the notch 220. Of course, in the other embodiments of the present application, the second link 314 can be rotatably disposed at the second support base 22 by other means, which is not limited herein.

Further, in the embodiment of the present application, the bottom side of the first link 313 is provided with a limiting groove 3130 for limiting, and one end of one of the torsion springs 32 sleeved on the rotational shaft 311 abuts within the limiting groove 3130, and the other end of which is abutted to the first support base. In addition, one end of the other torsion springs 32 sleeved on the rotational shaft 311 abuts to the limiting groove 3150 at bottom side of the baffle 315, and the other end of which is abutted at the first support base 21. By setting the limiting groove, the lateral movement of the torsion spring 32 is effectively avoided, and the position of the torsion spring 32 on the rotational shaft 311 is ensured. Of course, in other embodiments of the present application, the torsion spring 32 may be limited by other means according to actual conditions and specific requirements, which is not limited herein.

Figure 2:
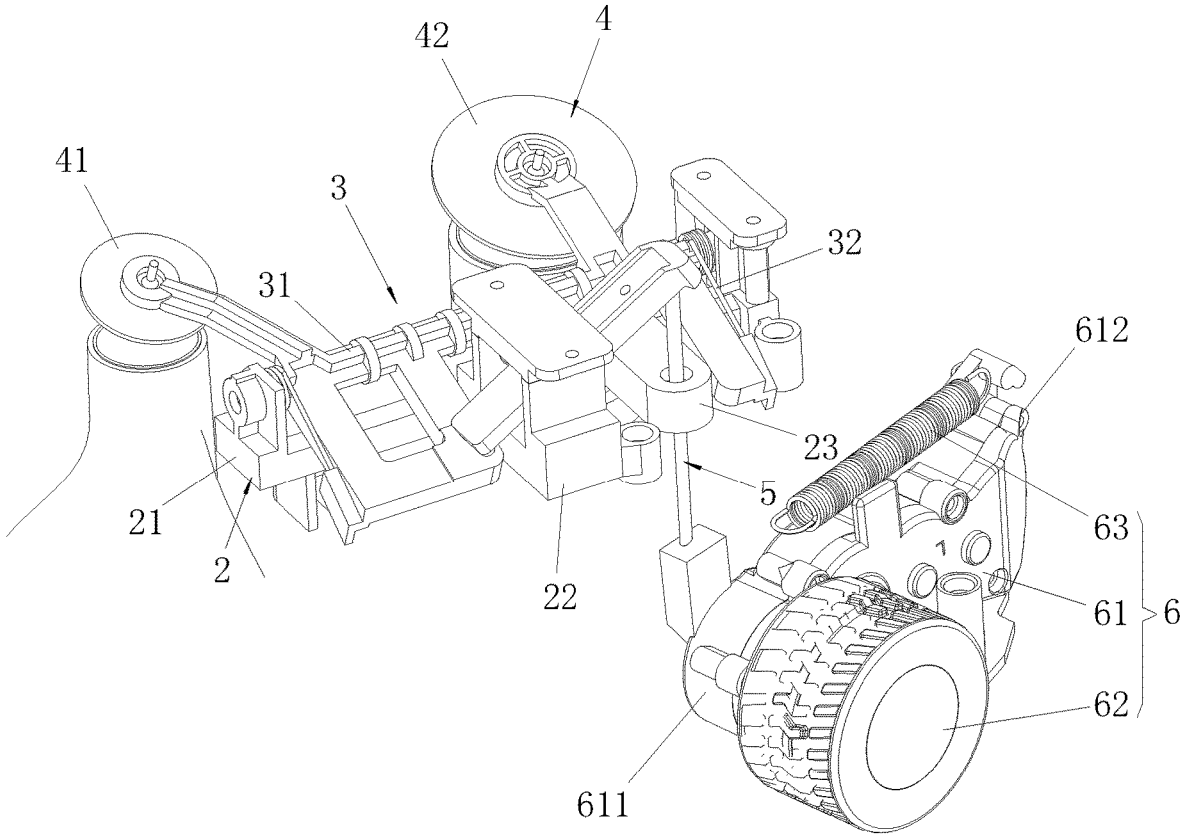
FIG. 2 is a perspective schematic view showing the cooperation of the seal assembly for waste water tank and the side wheel component in the embodiment of the present application.
Figure 3:
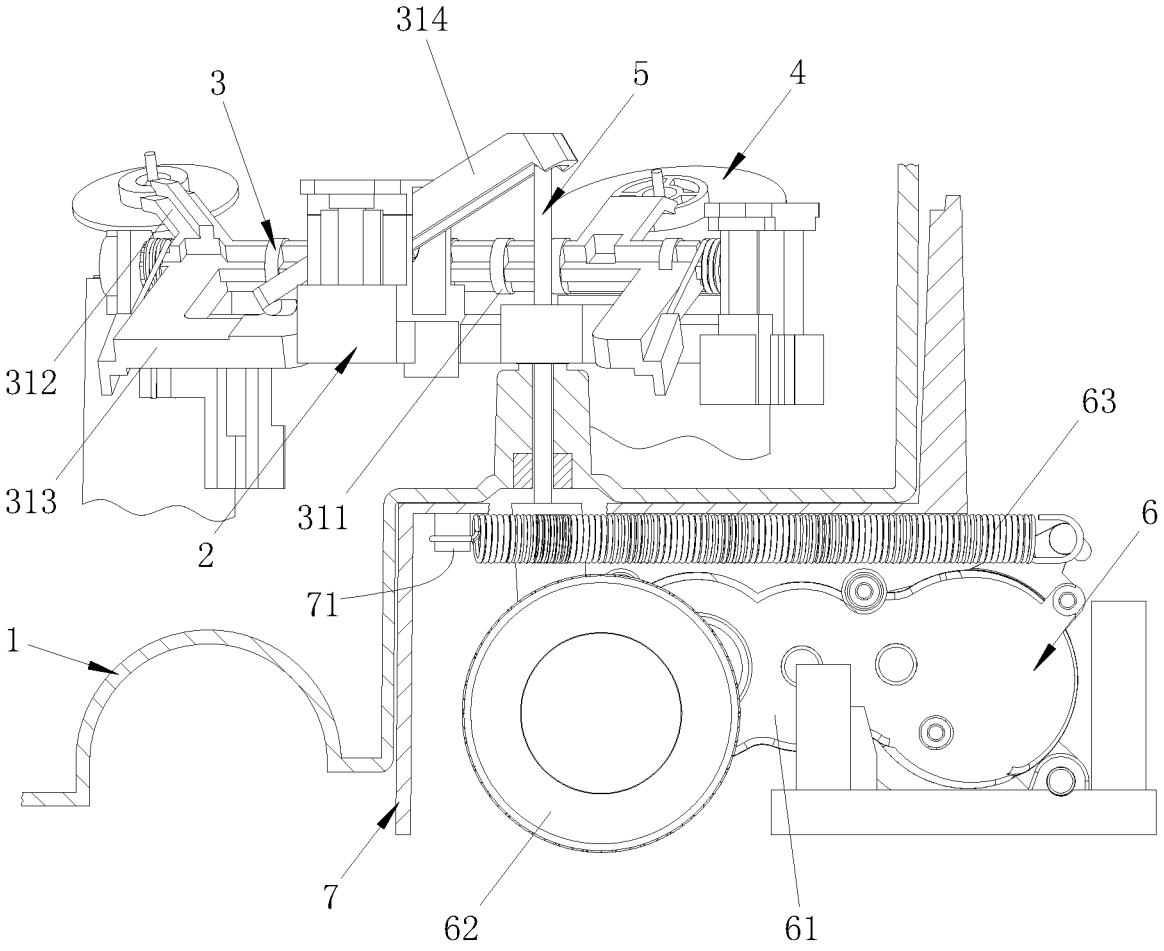
FIG. 3 is a schematic cross-sectional view showing the cooperation of the seal assembly for waste water tank and the side wheel component in the embodiment of the present application.
Figure 4:
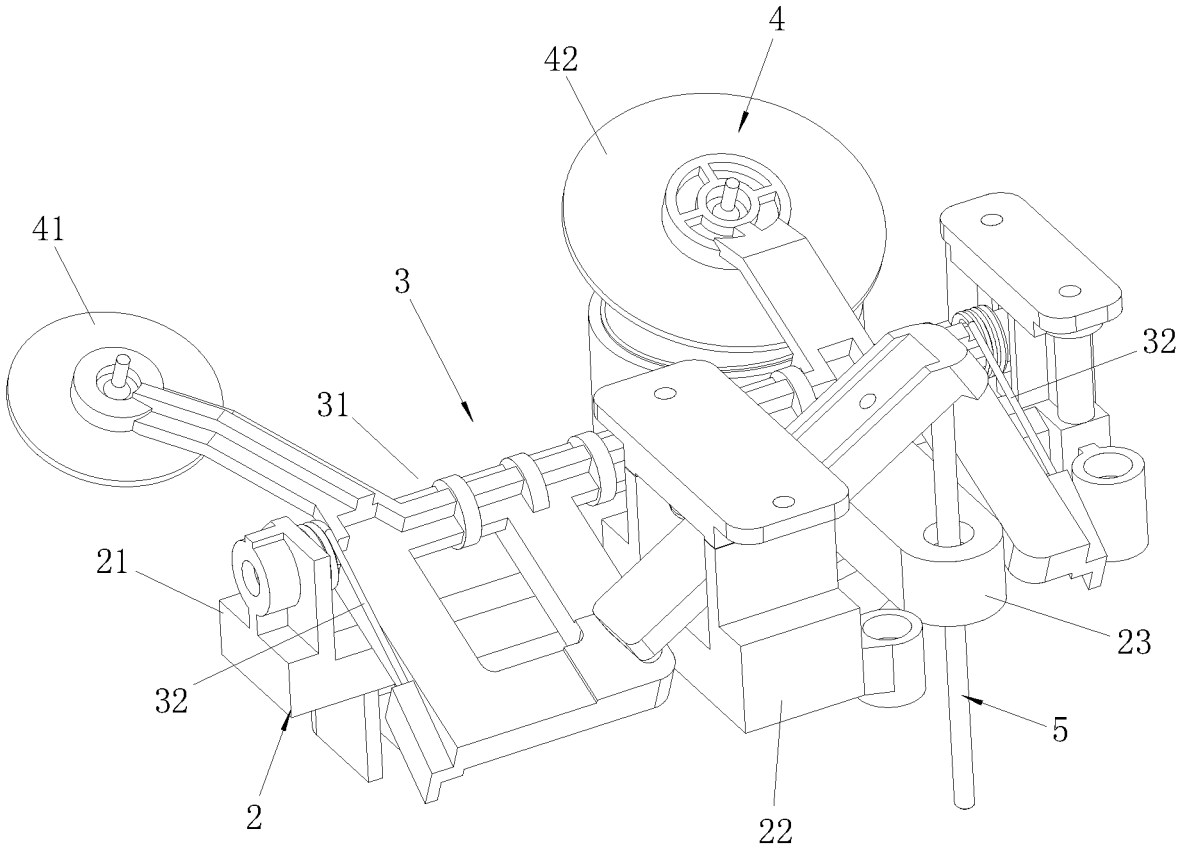
FIG. 4 is a perspective view of a seal assembly for waste water tank according to an embodiment of the present application.
Figure 5:
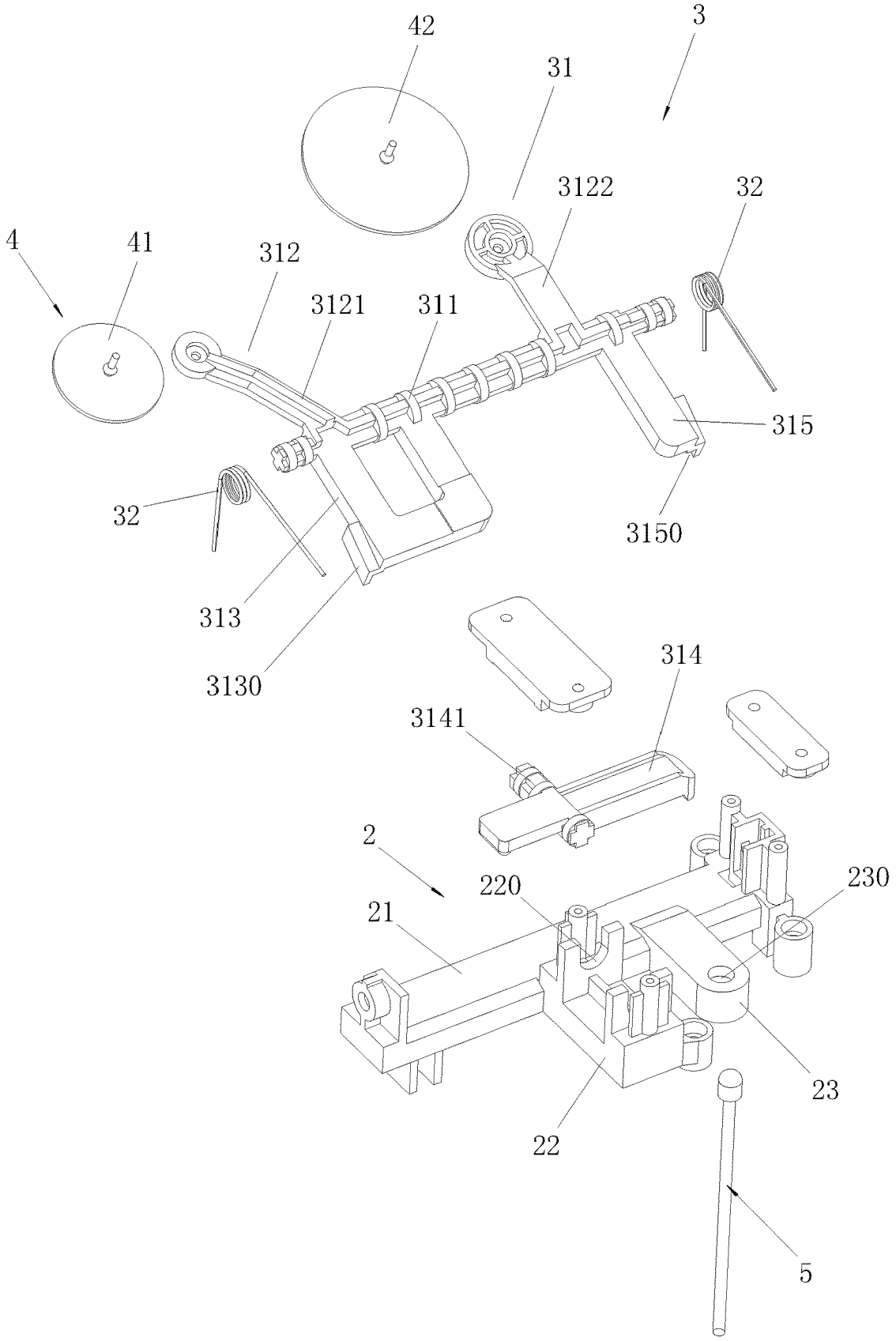
FIG. 5 is a schematic exploded view of a seal assembly for waste water tank according to an embodiment of the present application.

Further, in the embodiment of the present application, referring to FIG. 2 and FIG. 3, the above-mentioned side wheel component 6 may include a transmission case 61, a side wheel set 62 and a tension spring 63, wherein one opposite end of the transmission case 61 respectively being a transmission end 611 and a connection end 612, wherein the lower side of the connection end 612 is rotatably connected with the main body 7 of the floor cleaning machine, that is, the entire side wheel component 6 is rotatable about the center of rotation of the connecting end 612; the two ends of the tension spring 32 are respectively connected to the upper end of the connection end 612 and to the connection pin 71 on the main body 7, the connection pin 71 is located on the main body 7 near the transmission end 611; in addition, the side wheel set 62 is disposed at the transmission end 611, and the bottom end of the push rod 5 is connected to the side wall of the transmission end 611. Thus, when the waste water tank 1 or the floor cleaning machine is lifted and suspended from the floor, the side wheel set 62 and the transmission end 611 of the transmission box 61 are suspended, and the connection end 612 rotates around its center of rotation under the tension of the tension spring 63. the side wheel set 62 moves down with the transmission end 611, and drives the push rod 5 to move downward, and the waste water inlet 101 and the suction opening 102 are sealed; otherwise, when the floor cleaning machine is placed on the floor, the side wheel set 62 is lifted up when contact with the floor, the push rod 5 is moved up, and the waste water inlet 101 and the suction opening 102 are opened. In other embodiments of the present application, the side wheel component 6 described above may be of other configurations according to actual conditions and specific requirements.

Further, in the embodiment of the present application, the first sealing cover 41 and the second sealing cover 42 are preferably soft rubber covers. Of course, the first sealing cover 41 and the second sealing cover 42 may be other types of sealing cover members according to actual conditions and specific needs, which are not limited herein The aforementioned embodiments are only preferred embodiments of the present application, and are not intended to limit the present application. Any modification, equivalent replacement, improvement, and so on, which are made within the spirit and the principle of the present application, should be included in the scope of the present utility model. Therefore, the scope of the present application is subject to the scope of the claims.

What is claimed is:

1. Seal assembly for a waste water tank of a floor cleaning machine, the floor cleaning machine comprising a waste water inlet, a suction opening, and a side wheel component; the seal assembly being configured for sealing the waste water inlet and the suction opening, wherein the seal assembly comprises a base disposed at the waste water tank, a linkage movably disposed at the base, a sealing cover connected to the linkage and disposed at the waste water inlet and on the suction opening, and a push rod connected to the linkage and arranged for pushing the linkage to press the sealing cover to seal the waste water inlet and the suction opening; a bottom end of the push rod is configured for connecting to the side wheel component, and the push rod is movable up and down synchronously with the side wheel component.

2. The seal assembly of claim 1, wherein the linkage includes a link assembly movably disposed at the base, and a torsion spring configured for restoring the link assembly; the sealing cover being connected at one side of the link assembly, a top end of the push rod is connected at the other side of the link assembly.

3. The seal assembly of claim 2, wherein the link assembly includes a rotational shaft rotatably disposed at the base, a pair of cantilevers respectively connected with two ends of the rotational shaft on the same side thereof, and a first link connected to the rotational shaft and located on an opposite side of the cantilever, and a second link rotatably disposed at the base and located beside the first link; one end of the second link abuts against a top side of the first link, and the other end of the second link is connected to a top end of the push rod; the torsion spring is disposed such that the rotational shaft fits therethrough, and both ends of the torsion spring respectively abut against the base and a bottom side of the first link, and the sealing cover is connected to an outer end of the cantilever.

4. The seal assembly of claim 3, wherein the base comprises a first support base and a second support base; the second support base is perpendicular to the first support base; the rotational shaft is rotatably disposed to the first support base, and the second link is rotatably disposed to the second support base.

5. The seal assembly of claim 4, wherein the base further comprises: a guide plate having a guide hole, the guide plate is disposed in parallel to a lateral side of the second support base, and the push rod is disposed to movably extend through the guide hole.

6. The seal assembly of claim 3, wherein opposite sides of the second link has a protruding rotating arm, and the second support base is provided with a notch adapted to the rotating arm, and the rotating arm is rotatably accommodated in the notch.

7. The seal assembly of claim 3, wherein a limiting groove is disposed at a bottom side of the first link, and one end of the torsion spring abuts within the limiting groove.

8. A floor cleaning machine, comprising a waste water inlet, a suction opening, a side wheel component; and a seal assembly being configured for sealing the waste water inlet and the suction opening, the seal assembly comprises a base disposed at the waste water tank, a linkage movably disposed at the base, a sealing cover connected to the linkage and disposed at the waste water inlet and on the suction opening, and a push rod connected to the linkage and arranged for pushing the linkage to press the sealing cover to seal the waste water inlet and the suction opening; a bottom end of the push rod is configured for connecting to the side wheel component, and the push rod is movable up and down synchronously with the side wheel component;

wherein the side wheel component comprises a transmission box, a side wheel set and a tension spring, and the opposite ends of the transmission box respectively being a transmission end and a connection end, the lower side of the connection end is rotatably connected with main body of the floor cleaning machine, and two ends of the tension spring are respectively connected to an upper side of the connecting end and the main body, the side wheel set is disposed at the transmission end, and a bottom end of the push rod is connected with the transmission end.

* * * * *